US005685781A

United States Patent [19]

Pedersen et al.

[11] Patent Number: 5,685,781

[45] Date of Patent: Nov. 11, 1997

[54] GOLF CLUB SHAFT

[75] Inventors: Svein Pedersen, Askim, Norway; David S. Noyes, S. Boston, Mass.

[73] Assignee: Swix Sport A/S, Lillehammer, Norway

[21] Appl. No.: 603,270

[22] Filed: Feb. 20, 1996

[51] Int. Cl.[6] ..... A63B 53/12

[52] U.S. Cl. ..... 473/318; 473/323

[58] Field of Search ..... 473/316, 317, 473/318, 319, 320, 321, 322, 323

[56] References Cited

U.S. PATENT DOCUMENTS

| | | | |
|---|---|---|---|
| 1,713,812 | 5/1929 | Barnhart . | |
| 1,917,795 | 7/1933 | Fetter | 473/319 |
| 2,040,540 | 5/1936 | Young . | |
| 2,066,962 | 1/1937 | Cross | 473/323 |
| 2,086,275 | 7/1937 | Lemmon . | |
| 2,153,880 | 4/1939 | Barnhart . | |
| 2,220,852 | 11/1940 | Scott . | |
| 2,250,428 | 7/1941 | Vickery | 473/323 |
| 2,250,429 | 7/1941 | Vickery . | |
| 2,457,177 | 12/1948 | Reach . | |
| 3,170,690 | 2/1965 | Goranson et al. . | |
| 4,023,801 | 5/1977 | VanAuken | 473/319 |
| 4,123,055 | 10/1978 | Brill . | |
| 4,330,126 | 5/1982 | Rumble | 473/323 |
| 4,856,782 | 8/1989 | Cannan . | |
| 5,265,872 | 11/1993 | Tennent et al. . | |
| 5,316,299 | 5/1994 | Feche et al. . | |

FOREIGN PATENT DOCUMENTS

| | | | |
|---|---|---|---|
| 90 15387 | 12/1990 | France . | |
| 90 15388 | 12/1990 | France . | |
| 465414 | 5/1937 | United Kingdom . | |
| 465415 | 5/1937 | United Kingdom | 273/80 B |

OTHER PUBLICATIONS

Golfsmith Store, Apr. 1996, pp. 13 and 14, XPC Bulge graphite shaft.

*Primary Examiner*—Sebastiano Passaniti

*Attorney, Agent, or Firm*—Reising, Ethington, Barnard & Perry, PLLC

[57] ABSTRACT

A hollow golf club shaft including a plurality of diverging and converging substantially frustoconical sections. The sections have respective predetermined substantially constant wall thicknesses.

32 Claims, 3 Drawing Sheets

GOLF CLUB SHAFT

FIELD OF THE INVENTION

This invention relates generally to golf clubs and, more particularly, to an improved golf club shaft.

BACKGROUND ART

Young U.S. Pat. No. 2,040,540 discloses a metal shaft formed of sheet metal tubing which is tapered toward both ends, with the upper tapered section comprising the grip and covered by leather.

Lemon U.S. Pat. No. 2,086,275 discloses both a wood shaft and a steel shaft, each of which includes three tapered sections, with one tapered section being the grip section, and the thickness of the walls of the tubular shafts causing a variation in the exact points of beginning and end of the three sections of the shaft, and the degree of the taper of the sections.

Barnhart U.S. Pat. No. 2,153,880 discloses a hollow metallic tube with no straight sections, and several of the sections having varying wall thicknesses.

Vickery U.S. Pat. No. 2,230,429 discloses a tubular metallic shaft having three cylindrical sections with adjacent sections joined at abruptly changing diameters.

Tennent et al U.S. Pat. No. 5,265,872 discloses a shaft formed of composite of polymers reinforced internally by fibers, and having a "modified hourglass" shape, with an intermediate cylindrical section being the base rod itself of from 6 to 12 inches in length.

Feche et al U.S. Pat. No. 5,316,299 discloses three shaft embodiments, each made of a composite material and each including a tapered grip section connected at the small diameter end thereof by a short connecting portion to a larger diameter upper end of (1) a downwardly diverging full shaft length section (first embodiment), (2) a cylindrical section (second embodiment), and (3) a downwardly converging section (third embodiment).

French publication nos. 2,670,120 and 2,670,121 disclose tapered shafts of composite material including bulging and contracting cylindrical sections. Publication 2,670,121 further discloses a bi-cone form.

Graman USA Inc. discloses a golf club including a graphite shaft with a, so-called, Triple Flexpoint System (TFSI) having sections with variable tapered outer surfaces and constant tapered inner surfaces.

Paragon Sports discloses a golf club including a graphite shaft with two kickpoints (DKS), as the result of three progressively decreasing cylindrical sections.

SUMMARY OF THE INVENTION

A general object of the invention is to provide a golf club having an improved golf club shaft.

Another object of the invention is to provide a golf club having an improved composite material golf club shaft.

A further object of the invention is to provide a golf club with a hollow shaft wherein the shaft is selectively contoured between the grip and hosel ends thereof, with variously contoured sections having respective substantially constant wall thicknesses.

Still another object of the invention is to provide a golf club having a shaft which is shaped to include a grip end and a hosel end, and three or more intermediate sections having respective small diameter and large diameter connector circles.

A still further object of the invention is to provide a golf club having, in seriatim, a contoured shaft with a grip end section of a predetermined shape, a first diverging substantially frustoconical section, a converging substantially frustoconical section, a second substantially diverging frustoconical section, and a hosel section of a predetermined shape.

Still another object of the invention is to provide such a contoured shaft, wherein the connector circles have respective predetermined diameters and are spaced at predetermined distances apart.

These and other object and advantages will become more apparent when reference is made to the following drawings and the accompanying description.

BEST MODE FOR CARRYING OUT THE INVENTION

Figure 1:
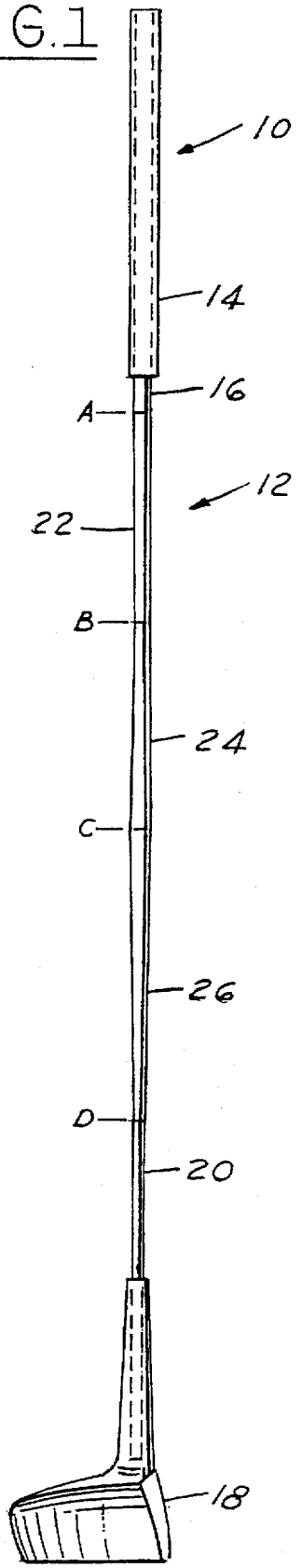
FIG. 1 is a side elevation view of a golf club embodying the invention.

Referring now to the drawings in greater detail, FIG. 1 illustrates a golf club 10 having a one-piece shaft 12 formed of a composite material, such as tubular material or sheets of carbon fibers and epoxy resin, or fiber glass and epoxy resin.

A grip 14 is formed and secured in any suitable manner around a grip end section 16 which is preferably cylindrical in shape, and a club head 18 is secured in any suitable manner to a bottom hosel section 20 which is preferably cylindrical in shape. A converging substantially frustoconical section 22 extends from the grip end section 16 at a first circle A to a small diameter circle B. A diverging substantially frustoconical section 24 extends from the section 22 at circle B to a large diameter circle C. A second converging substantially frustoconical section 26 extends from the section 24 at circle C to a small diameter circle D at the beginning of the hosel section 20. The club head 18 is secured to the hosel section 20 to complete the golf club 10 structure.

Respective outer diameter ranges in mm are: at A 14 to 20; at B 11 to 16; at C 14 to 20; and at D 8 to 12.

Respective section lengths in mm are: for 16 170 to 500; for 22 100 to 300; for 24 100 to 300; for 26 180 to 480; and for 20 100 to 400.

A tabulation of suggested diameters at the various points along the shaft, and suggested lengths of the respective series of sections is as follows:

| Section | Shape | Length in mm | Outer Diameter in mm |
|---|---|---|---|
| 16 to A | cylindrical | 193 | at A: 14.86 |
| 22 to B | converging | 200 | at B: 12.00 |

-continued

| Section | Shape | Length in mm | Outer Diameter in mm |
|---|---|---|---|
| 24 to C | diverging | 200 | at C: 14.86 |
| 26 to D | converging | 280 | at D: 8.61 |
| 20 from D | cylindrical | 270 | |

Each section 16, 20, 22, 24, and 26 has its own predetermined substantially constant wall thickness. A suggested wall thickness is in the range of 1 to 3 mm, wherein a preferred thickness is 1.1 mm for sections 16, 22, 24 and 26; and 1.5 mm for section 20. The section 24 wall thickness may, at times, average 1.1 mm, while varying from 1.3 mm at circle B to 0.9 mm at circle C.

While the above dimensions are preferred, each length, diameter and wall thickness may be specially varied to be better suited to golfers of different heights, reaches, strengths, swing tempos, and preferred ball flight trajectories. For example, if the length of section 16 is increased to 273 mm and the length of section 20 is shortened to 190 mm, in order to maintain the same overall length, the result is a shaft producing a lower launching angle providing a lower ball flight, less backspin, and greater roll on landing. Such a shaft may be preferable for a player who tends to hit the ball high. A similar result may be attained by increasing the length of sections 26 and/or 24, while decreasing the length of sections 16 and/or 20, while maintaining the same overall length, or by increasing the shaft diameters at circles B and D. The opposite effect of a "softer" feeling shaft and a resultant higher ball flight is produced by reducing the length of sections 24 and/or 26, while increasing the length of sections 16 and/or 20, and maintaining the same overall length. Also, the numbers of frustoconical sections may be varied. An additional reason to vary the dimensions and number of frustoconical sections may be to accommodate different golf clubhead and grip weights and specifications.

Figure 2:
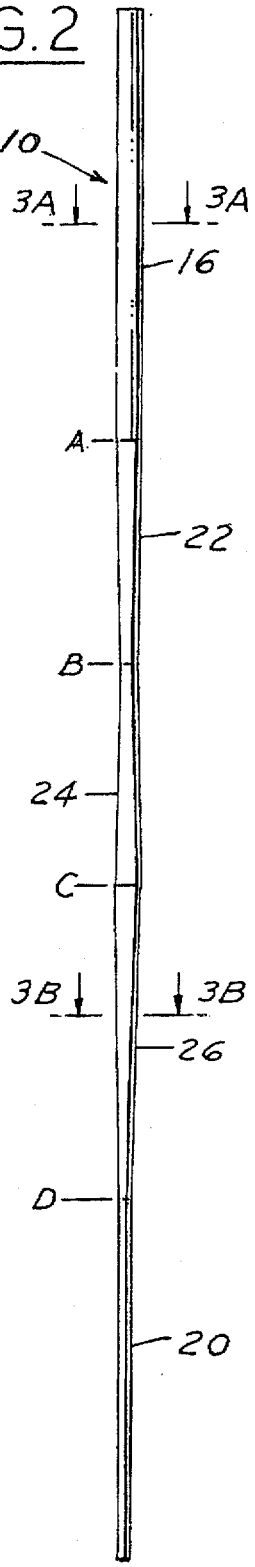
FIG. 2 is a side elevational view of the inventive golf club shaft.
Figure 3A:
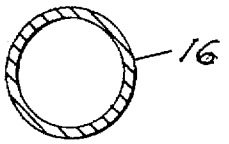
FIGS. 3A and 3B are cross-sectional views taken along the planes of the line 3A—3A and 3B—3B, respectively, of FIG. 2, and looking in the directions of the arrows.
Figure 3B:
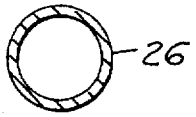
Figure 4:
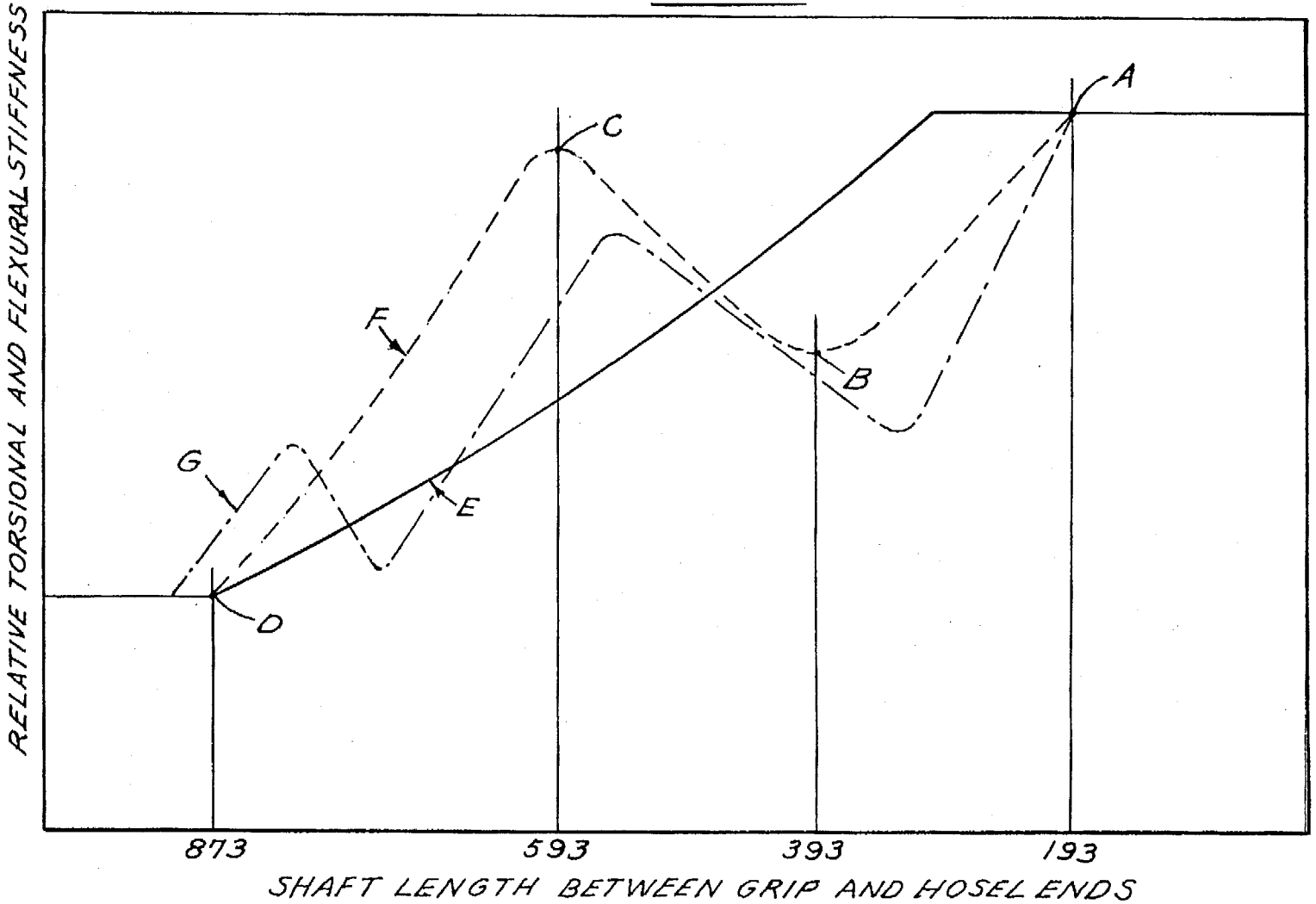
FIG. 4 is a chart showing the relative flex and torsional resistance of three golf club shafts at varying points along their length from the club head end to the grip end.

Referring now to the chart of FIG. 4, comparative flex and torsional resistance points are shown for each of the following types of golf club shafts:

Line E represents a traditional single-tapered shaft;

Line F represents the three frustoconical sectioned shaft of FIGS. 1 and 2; and Line G represents a shaft having five frustoconical sections.

The shafts of lines F and G can be looked upon as "multiple lever systems", which, through centrifugal force, produce greater acceleration, and a more efficient transfer of the golfer's energy from the hands to the clubhead. This is achieved without added material, which results in excess weight. The greater clubhead momentum provided by such shafts gives inherently greater resistance to twisting during the swing.

Figure 5:
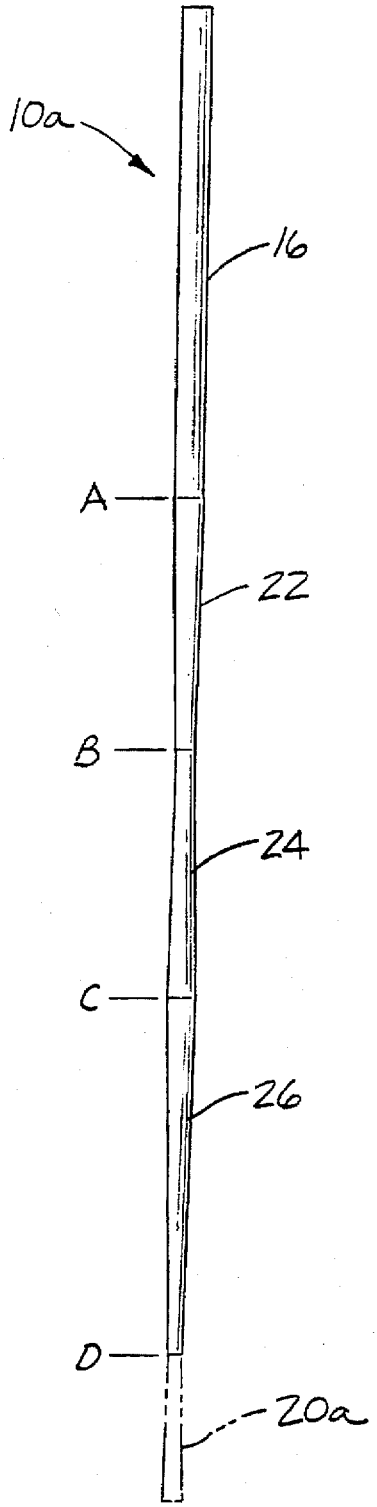
FIGS. 5 and 6 are side elevational views of alternate embodiments of the invention.

Referring now to FIG. 5, the golf club 10*a* is similar to FIG. 2, except that a bottom hosel end section 20*a* is a diverging substantially frustoconical section on which the club head 18 is mounted.

Figure 6:
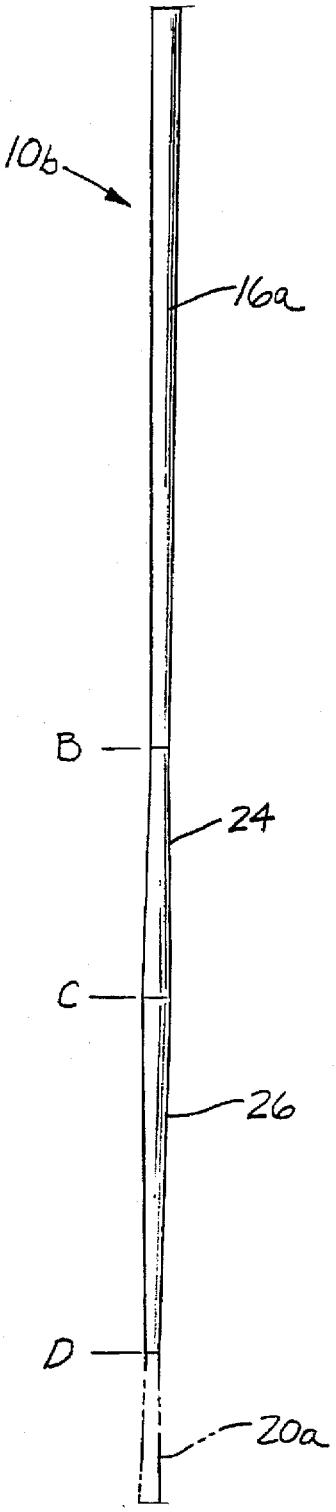

Referring to FIG. 6, a golf club 10*b* is similar to FIG. 5, except that a section 16*a* is a converging substantially frustoconical section, replacing sections 16 and 22.

Industrial Applicability

It should be apparent that by incorporating a variety of composite materials, even in various portions of the shaft, and varying the respective lengths, wall thicknesses, and end diameter dimensions of a plurality of sections, an unprecedented variety of torsional resistance, flexural, and weight distribution profiles are available, adapted to suit the preferences of a wider variety of golfers in providing lightweight shafts with improved performance in conjunction with various clubheads and grips, without requiring added material and consequent excess weight.

More specifically, increased and decreased cross-sections (internal diameter) allow for fine-tuned flexibility and torsional resistance over the full length of the shaft. For example, variable "flex points" can be built into the shaft, which enables different launching angles without changing other factors, such as club head loft, length, etc.

Multiple tapers create multiple flex and torsional resistance points. "Hinging action" creates greater club head speed. Flexing takes place over a larger portion of the shaft, bringing more of the shaft into play, while spreading any stresses more evenly along the shaft to provide greater durability than conventional shafts with a single internal taper.

Using multiple substantially frustoconical outer and inner shapes provides multiple flex points without requiring excess weight, and serves to result in a pleasing, powerful sound in use, while producing a comfortable feel and feedback to the golfer, in the form of a perceptible feeling of the shaft "loading" and "unloading" or "kicking".

While but three general embodiments of the invention have been shown and described, other modifications thereof in the number of frustoconical sections and their respective end diameters, lengths, and wall thicknesses are possible within the scope of the following claims.

What is claimed is:

1. A hollow golf club shaft having a grip end, a hosel end, and a club head secured to the hosel end thereof, characterized by the hollow shaft including a plurality of diverging and converging substantially frustoconical sections between the grip and hosel ends, with both small and large, frustoconical section ends spaced from the grip and hosel ends, and including at least one intermediate diverging section, and each section having its own predetermined substantially constant wall thickness.

2. The hollow golf club shaft described in claim 1, wherein each of said grip and hosel ends are cylindrical sections.

3. The hollow golf club shaft described in claim 2, wherein the hosel cylindrical section wall thickness is on the order of 1.1 mm.

4. The hollow golf club shaft described in claim 2, wherein said grip end is larger in diameter than said hosel end.

5. The hollow golf club shaft described in claim 4, wherein the diameter of said grip end section is in the range of 14 to 20 mm, and the diameter of said hosel end section is in the range of 8 to 12 mm.

6. The hollow golf club shaft described in claim 4, wherein the diameter of said grip end section is on the order of 14.95 mm, and the diameter of said hosel end section is on the order of 8.51 mm.

7. The hollow golf club shaft described in claim 4, wherein said plurality of substantially frustoconical sections is at least three.

8. The hollow golf club shaft described in claim 1, wherein said plurality of substantially frustoconical sections include two diverging frustoconical sections and one converging frustoconical section.

9. The hollow golf club shaft described in claim 1, wherein said shaft is formed of a composite material.

10. The hollow golf club shaft described in claim 9, wherein said composite material includes fibers and resin.

11. The hollow golf club shaft described in claim 9, wherein the composite material includes carbon fibers and epoxy resin.

12. The hollow golf club shaft described in claim 9, wherein said composite material is one of the group consisting of tubular material of carbon fibers and epoxy resin, sheets of carbon fibers and epoxy resin, and fiber glass and epoxy resin.

13. The hollow golf club shaft described in claim 1, wherein each section's substantially constant wall thickness is in the range of 1 to 3 mm.

14. The hollow golf club shaft described in claim 1, wherein each substantially constant wall thickness is on the order of 1.5 mm.

15. A hollow golf club comprising a hollow shaft having a grip end and a club head secured to the hosel end thereof, said grip end and said hosel end each being a section comprising a pre-determined shape, and a plurality of at least three smoothly connected non-cylindrical sections therebetween shaped so as to provide a varying flexural and torsional stiffness, wherein each of said plurality of at least three smoothly connected non-cylindrical sections is shaped as a substantially frustoconical section, and having both small and large frustoconical section ends spaced from the grip and hosel ends, and including an intermediate diverging section.

16. The golf club described in claim 15, wherein each of said grip end and hosel end sections is shaped as a cylinder.

17. The golf club described in claim 15, wherein each of the sections has its own predetermined substantially constant wall thickness.

18. The golf club described in claim 17, wherein each of the sections has the same substantially constant wall thickness.

19. The golf club described in claim 15, wherein the junctures between adjacent sections are circles which provide particular flex points.

20. The golf club described in claim 19, wherein the circles between adjacent sections are rounded annular segments, in contrast to being a sharp edge.

21. A golf club shaft having a grip end and a hosel end and formed of a composite material, characterized by a plurality of substantially frustoconical sections formed between the grip end and the hosel end, wherein each frustoconical section has its own predetermined substantially constant wall thickness.

22. A hollow golf club shaft having a grip end, a hosel end, and a club head secured to the hosel end thereof, characterized by the hollow shaft including a plurality of diverging and converging substantially frustoconical sections including at least one of the grip and hosel end, with both small and large frustoconical section ends spaced from the grip and hosel ends, and including at least one intermediate diverging frustoconical section, and each section having its own predetermined substantially constant wall thickness.

23. The hollow golf club shaft described in claim 22, wherein the grip end is a converging substantially frustoconical section.

24. The hollow golf club shaft described in claim 22, wherein the hosel end is a diverging substantially frustoconical section.

25. The hollow golf club shaft described in claim 22, and wherein the grip end is a substantially frustoconical section.

26. The hollow golf club shaft described in claim 25, wherein the grip end is a converging substantially frustoconical section.

27. The hollow golf club shaft described in claim 26, wherein the grip end and adjacent section are one continuous converging substantially frustoconical section.

28. The hollow golf club shaft described in claim 22, wherein said plurality of diverging and converging substantially frustoconical sections is at least four.

29. A hollow golf club shaft having a grip end, a hosel end, and a club head secured to the hosel end thereof, characterized by the hollow shaft including a plurality of diverging and converging substantially frustoconical sections between the grip and hosel ends, and each section having its own predetermined substantially constant wall thickness, wherein said plurality of substantially frustoconical sections is three, wherein said substantially frustoconical sections include a first converging frustoconical section extending from said grip end section, a diverging frustoconical section extending from said first converging frustoconical section, a second converging frustoconical section extending from said diverging frustoconical section to said hosel end section.

30. The hollow golf club shaft described in claim 29, wherein the first converging frustoconical section varies from a diameter in the range of 14 to 20 mm to a diameter in the range of 11 to 16 mm, the diverging frustoconical section varies from a diameter in the range of 11 to 16 mm to a diameter in the range of 14 to 20 mm, and the second converging frustoconical section varies from a diameter in the range of 14 to 20 mm to a diameter in the range of 8 to 12 mm.

31. The hollow golf club shaft described in claim 29, wherein the first converging frustoconical section varies from a diameter on the order of 14.95 mm to a diameter on the order of 12.00 mm, the diverging frustoconical section varies from a diameter on the order of 12.00 mm to a diameter on the order of 14.95 mm, and the second converging frustoconical section varies from a diameter on the order of 14.95 mm to a diameter on the order of 8.51 mm.

32. The hollow golf club shaft described in claim 29, wherein the lengths of said sections from the grip end section to the hosel end section are on the orders of 193, 200, 200, 280, and 270 mm, respectively.

* * * * *